US006142475A

United States Patent [19]

Hennessey

[11] Patent Number: 6,142,475

[45] Date of Patent: Nov. 7, 2000

[54] COLLECTABLE CARD GAME

[76] Inventor: Joseph A. Hennessey, 4312 Chestnut St., Bethesda, Md. 20869

[21] Appl. No.: 09/326,649

[22] Filed: Jun. 7, 1999

Related U.S. Application Data

[62] Division of application No. 08/970,807, Nov. 14, 1997, Pat. No. 6,017,034.

[51] Int. Cl.[7] ..... A63F 1/00

[52] U.S. Cl. ..... 273/296; 273/292; 273/308; 273/307

[58] Field of Search ..... 273/292, 296, 273/297, 298, 300, 302, 304, 306, 307, 308

[56] References Cited

U.S. PATENT DOCUMENTS

| | | |
|---|---|---|
| 74,368 | 2/1868 | Jackson . |
| 739,678 | 9/1903 | Ives . |
| 816,119 | 3/1906 | Harrison . |
| 836,537 | 11/1906 | Janson . |
| 1,146,798 | 7/1915 | James . |
| 1,314,522 | 9/1919 | Knoos . |
| 1,357,166 | 10/1920 | Hart . |
| 1,515,170 | 11/1924 | Reece . |
| 1,553,736 | 9/1925 | Wyle . |
| 1,855,543 | 4/1932 | Dalton . |
| 3,603,593 | 9/1971 | Chew . |
| 3,756,604 | 9/1973 | Laszlo . |
| 4,588,193 | 5/1986 | Winston . |
| 4,635,939 | 1/1987 | Makow . |
| 4,824,118 | 4/1989 | Fusaro et al. . |

(List continued on next page.)

FOREIGN PATENT DOCUMENTS

| | | |
|---|---|---|
| 29501163 | 3/1995 | Germany . |
| 2193900 | 2/1988 | United Kingdom . |

OTHER PUBLICATIONS

Rules for "Mille Bornes" game by Parker Brothers.

Europe Search Authority International Search Report dated Nov. 1997 for PCT/US98/24249.

*Primary Examiner*—Jeanette Chapman
*Assistant Examiner*—V K Mendiratta
*Attorney, Agent, or Firm*—Banner & Witcoff, Ltd.

[57] ABSTRACT

A collectible card game that represents the unwritten rules of political, economic and popular culture is disclosed. The game is designed for play by three to six players. Larger groups are accommodated by additional decks of cards. To play the game, each player must adopt fictitious roles based on predetermined demographic characteristics. In the preferred embodiment, these roles are based on a generational affiliation and a place of residence. The accumulation of card points is dependent upon these generational and residential choices. The game has a card holder and a deck of playing cards. The card holder is designed to hold four different piles of cards: the Pick Up Pile, the Recycling Bin, the Litigation Fund, and the 501(c)(3) Pile. The deck of cards is composed of three different categories of cards: three-value cards, policy cards, and disaster cards. A three-value card represents a desired good or service the value of which is dependent upon the demographic category chosen by the player at the beginning of the game. A policy card is a card that may be played by a player against an opposing player to slow the opposing player's accumulation of three-value cards. A disaster card is a card that an unlucky player picks from the Pick Up Pile that generally forces a distribution of that player's three-value cards to the other players. A player who losses cards due to the play of policy cards or disaster cards may be able to rely on either the Litigation Fund or the 501(c)(3) Pile for replacement cards. Six cards are dealt to each player to begin the game. Each player is required to hold six cards in hand at all times. To accumulate points, each player collects three-value cards in his or her Accumulated Asset Pile located directly in front of him. The game continues until all of the cards have been picked up from the Pick Up Pile. The winner is the player with the most points relevant to his paricular demographic category in his or her Accumulated Asset Pile when the last card has been taken from the Pick-Up Pile.

12 Claims, 7 Drawing Sheets

U.S. PATENT DOCUMENTS

| | | |
|---|---|---|
| 4,846,480 | 7/1989 | Oliver . |
| 5,052,692 | 10/1991 | Gustafson . |
| 5,080,369 | 1/1992 | Mongno . |
| 5,092,596 | 3/1992 | Bucaria . |
| 5,106,100 | 4/1992 | Yih . |
| 5,180,306 | 1/1993 | McInroy et al. . |
| 5,375,846 | 12/1994 | Smith . |
| 5,435,568 | 7/1995 | Black . |
| 5,632,488 | 5/1997 | Sturm . |
| 5,662,332 | 9/1997 | Garfield . |
| 5,863,043 | 1/1999 | Bitner . |

COLLECTABLE CARD GAME

This application is a division of Ser. No. 08/970,807 now U.S. Pat. No. 6,017,034 issued on Jan. 25, 2000.

BACKGROUND OF THE INVENTION

It is clear to the applicant that high technology is steering people toward solitary forms of entertainment; political discourse has become, in many aspects, predictable and stale; polarization between generational and demographic groups, once a temporary aberration, seems to have become such an immutable part of culture as to make discussion about generational and demographic differences futile. Thus, it is evident that there is a need for a mechanism that will encourage people to entertain in social groups, promote a dialogue about politics and economics, and foster a non confrontational exchange of views about values across generational and demographic groups.

The mechanism that is best suited for this purpose would be card game. A card game is a particularly social form of entertainment. The variation inherent in card games best captures the variation inherent in modern life. The type of card game that would meet the need described would require players to employ many of the skills gained as "players" in modern society in order to compete as players in the game. The choices available in the card game would reflect the various choices available in modern society. The game would sufficiently parody the "rules" of popular culture, economics, and politics such that the participants would have opportunity to learn about the forces and influences that shape modern society. Ideally, the card game would provide entertainment value while at the same time serving as a vehicle for social criticism and commentary. Card games are particularly well suited to fill this need since a card game relies less on chance (there being no dice to roll nor wheels to spin) and card games generally require more demanding strategies than other types of games.

CARD GAMES IN A HISTORIC CONTEXT

Card games have long been a source of entertainment and a tool for education. Card games reportedly date as far back as the 9th Century when the Chinese Emperor Mu-tsung played a version of domino cards. It is thought that playing cards were introduced into Europe from Egypt. A card game from the region of Mameluks in Egypt, a playing card deck of 52 cards with suits of swords, polo-sticks, cups, and coins, dates to the 14th Century. Card games have not always been well-received. Town ordinances of Paris (1377) and St. Gallen (1379) reportedly prohibited card-play by members of the working class. Religious leaders of Bologna condemned card playing and, in 1423, thousands of cards were burned. This spectacle was repeated in 1452. The earliest known English card games date around 1520, and the earliest surviving English deck (French suited) dates around 1590.

A DESCRIPTION OF THE PRIOR ART

Many different card games present challenges to skill and strategic thinking. Many card games have been proposed that are designed to aid the education process. Card games have been developed to provide an entertaining method for players to understand unwritten rules that govern transactions and commerce. Other card games are designed to encourage discussion of seldom discussed topics. Still other games have been proposed for the improvement of the one-card, one-value style of the standard playing card deck.

Other games employ playing cards for fantasy role-playing purposes. The present invention, however, is designed to fill a need that no card game has been developed to address. Specifically, this card game has been invented to provide a means for people of different generations and demographic groups to come together to play a game that entertains; requires skillful value-based strategy decisions; educates players about the unwritten rules that govern our political, economic and political culture; encourages a discussion of issues seldom discussed across generations; and uses an innovative three-value system of cards that reflect different role-playing assignments among the players.

Games associated with the 52-card standard playing cards are those that come most readily to mind when associating card games with skill and strategic thinking. Poker, Bridge, and even such games as "Go Fish" and "Crazy Eights," long in the public domain, challenge players to plan several steps ahead of a current turn in order to succeed. Parker Brothers has marketed a French card game Mille Borne in the United States—a game that requires players to skillfully overcome "Hazard" cards in order to collect exactly 1000 points in "mileage" cards. Another card game, "UNO," requires strategic thinking by players in order to successfully match colors, numbers or words. A more recent game, U.S. Pat. No. 5,092,596, (Bucaria) challenges players to make strategic decisions as relating to owning and running a professional baseball team. Standard playing card games, and games such as UNO, however, fail to hold the public's attention because the strategies employed are designed for the accumulation of card points—points that do not correspond to appetites and wants outside the card game, i.e. the needs and wants that are a part of our everyday life. Strategy games such as that described in U.S. Pat. No. 5,092,596 are deficient because they do not reflect real-life strategies that we all employ as part of surviving in the modern world.

Many other types of card games have been proposed that are designed to aid the education process. Aside from trivia-type games that pose questions and reveal answers, many games have been developed to familiarize players with political issues. For example, United States Patent U.S. Pat. No. 816,119 (Noonan) was designed in part to educate players with about the Electoral College and the political calculus that went into electing a person as President of the United States. U.S. Pat. No. 1,357,166 (Harted) was designed to familiarize players with leaders of World War I. The limitations upon these games are that they are designed primarily to familiarize players with objective names and institutions. These games are not designed to educate players as to how these names and institutions are subjectively perceived by different generational and demographic groups.

Card games have been developed to provide an entertaining method for players to understand unwritten rules that govern various segments of our society. U.S. Pat. No. 1,146,798, (James) was designed, in part, to help educate players to the unwritten rules and procedures that govern the purchase of real estate. U.S. Pat. No. 1,553,736 (Wyle) was created to help educate players about the unwritten rules that govern the trading of stocks and bonds. U.S. Pat. No. 1,855,543 (Dalton) helps to educate players as to the unwritten rules that govern political party conventions. A recently patented game, U.S. Pat. No. 5,632,488 (Strum) is designed to familiarize players with the unwritten rules that go into creating political consensus. The short coming of these games is that they are limited to relatively narrow and specialized segments of our society. They ignore the fact that modern society itself operates by certain unwritten rules that can by captured by the dynamics of a card game.

Card games are powerful tools for communication. They are capable of serving as a mechanism for the discussion of topics that might not be raised among friends, family or strangers. For example, U.S. Pat. No. 1,314,522 (Knoos) was designed to encourage discussion between males and females at social gatherings. U.S. Pat. No. 4,635,939 (Makow), is a game that is designed to encourage the discussion of ethics as applied to various real-world scenarios. U.S. Pat. No. 5,375,846 (Smith) is a game that is designed to encourage a discussion of sexual etiquette and ethics. However, none of these games and no game known to the inventor is designed specifically to encourage members of different generational groups to discuss politics, ethics, values, economics and consumer culture.

As for the mechanics of playing card games, there have been attempts to improve the "one-card, one-value" system as typified in the standard card deck. In U.S. Pat. No. 4,588,193 (Winston) describes an alternative deck of cards that consists of three different suits with four different number values per suit such that every number value of a given suit is paired once with every number value of the other suits. This alternative to the standard card deck proved to be difficult to perfect because it was necessary to maintain a precise mathematic balance among each and every value in order to ensure that the card deck is a "fair" one. This innovation is extremely limited because in the name of preserving "fairness," U.S. Pat. No. 4,588,193 sacrifices expression and flexibility. Specifically, such a card game, determined to preserve the mathematical fairness of the card distribution, cannot reflect the fundamental unfairness, i.e. disparities that exist in our popular culture. Moreover, the system of valuation described by U.S. Pat. No. 4,588,193 cannot serve an editorial function by applying different values to an object that is featured in the center of the playing card.

Other card games employ playing cards for fantasy role-playing purposes. U.S. Pat. No. 5,092,596 (Bucaria) is a game the allows players to play the role of a major league baseball owner so as to familiarize players about the business aspects of owning and running a major league baseball team. A popular card game called "Magic," produced by Wizards of the Coast, allows players to adopt fictitious roles for battle and treasure-finding purposes. The shortcoming of these games is that the roles that are played out are so removed from the actual experience of the players that the value of these games as tools for education and understanding is suspect. U.S. Pat. No. 5,375,846 (Smith) employs role-playing by players that correspond more directly with experiences in the real world. However, this prior art utilizes real-world role-playing for the important, yet narrowly-defined, purpose of soliciting viewpoints on sexually-related issues such as sexually-related social dilemmas, sexual etiquette, and sensitivity.

Thus, a survey of the prior art reveals that no card game is adequately suited to fill the entertainment, communication, and education purposes envisioned. Thus, it would be necessary to conceive of and create a new, useful, and non-obvious card game that fills the need identified by the applicant.

BRIEF SUMMARY OF THE INVENTION

The present invention meets the need described above. It is a collectible card game that recreates the socializing dynamic of previous art forms, yet does so in a uniquely sophisticated, thought-provoking, contemporary, and dynamic manner. This card game is designed to, not only be a source of entertainment, but a catalyst for dialogue concerning the society we have created and the values that inform the public ethos. The game is designed to parody the unwritten rules that govern political, economic, and popular culture. To accomplish this, the game employs an ever-changing array of three-value cards that reflect current trends in the consumption of desired goods and services. It encourages political dialogue through the use of policy cards that conjure-up the symbols, images, and policy choices championed by elected officials, private citizens, corporations, and associations. The play of disaster cards challenge basic generational assumptions about appropriate responses to unexpected hardship. The game also challenges players with an array of strategic choices concerning how to allocate resources. Players must chose between accumulating goods and services in an Accumulated Asset Pile, devoting resources to legal processes through the Litigation Fund, donating goods and services to charity through the 501(c)(3) Pile, extending the cycle of consumption by discarding into the Recycling Bin, or disrupting another player's accumulation of three-value cards through the play of policy cards. While the object of the game is to accumulate the most value in three-value cards prior to the distribution of the last card in the Pick-Up Pile, the strategy that the winning player adopts to achieve that goal is itself the stuff of meaningful dialogue about decision-making in the modern world.

DETAILED DESCRIPTION OF THE INVENTION

Features of the Preferred Embodiment

The game includes a deck of individually designed cards and a card holder. In the preferred embodiment, the initial "starter" deck of cards consists of 100 cards in various combinations of three-value cards, policy cards, and disaster cards. The reverse side of each type of card is like appearance, so that when viewed from the reverse a number of such cards held in a player's hand are indistinguishable one from another. However, the front side of each type of card is composed of a unique design (in the preferred embodiment using green as the background color for the three-value cards, blue as the background color for the policy cards, and red as the background color for the disaster cards) such that the three-value cards, policy cards, and disaster cards are immediately distinguishable when viewed from the front side. The "starter" deck is designed to be played by three to six players. Players may facilitate larger groups by combining multiple "starter" decks into one large deck or by collecting supplement cards. In addition, the cards will be constantly updated to reflect changes in popular, political, and economic culture and will be available for sale in collector packs. Thus, the game never goes out of date. In fact, the game is designed to be a running commentary on popular, political, and economic culture.

Three-value cards represent goods and services available in society. The three-value cards are the mechanism for keeping score and for determining the eventual winner. To accumulate three-value cards for score-keeping purposes, a player must place three-value cards in that player's "Accumulated Asset Pile" located immediately in front of that player. The "Accumulated Asset Pile" contains the cards that a player seeks to have counted toward his point total at the end of the game. In the preferred embodiment, these cards are displayed face-up so that each three-value card can be seen by the other players. Only the three-value cards in the Accumulated Asset Pile are counted towards a player's point value at the end of the game. The winner of the game is the player who has accumulated the most value in three-value cards in that person's Accumulated Asset Pile.

Figure 1:
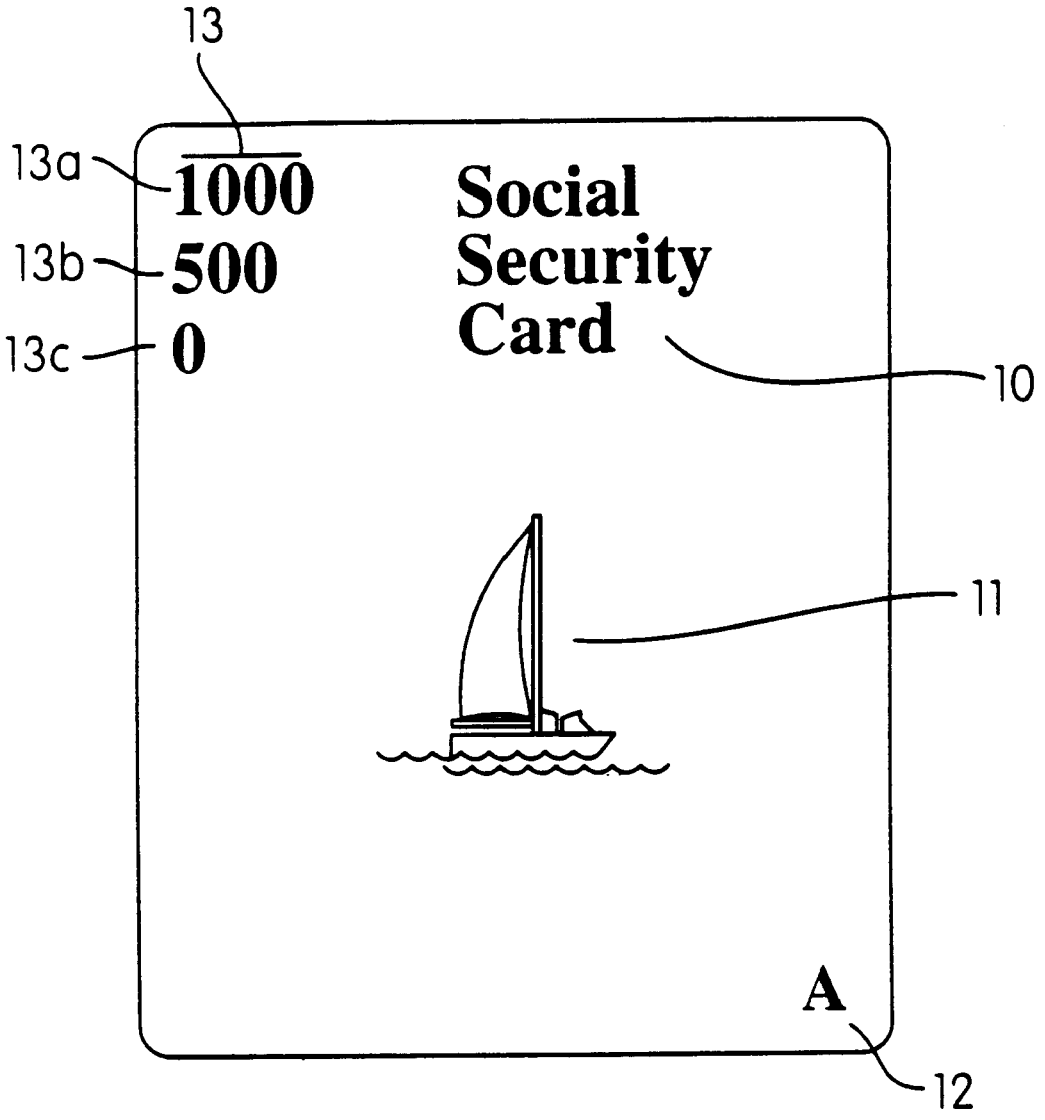
FIG. 1—Is the front view of a typical three-value card.

As shown in the embodiment pictured in FIG. 1, an three-value card has four distinctive features: (1) the text feature, (2) the graphic commentary feature, (3) the category feature, and (4) the three value feature. Text appears in the upper-center portion of the card 10. The text labels the particular good or service featured by the card. Below the text in the center of the card is a graphic commentary 11 concerning the good or service featured by the card. The graphic commentary features one or more symbols that serves to comment on the good or service identified by the text. By the particular art selected to represent the featured named by the text, the graphic commentary feature serves as a mini-editorial on the good or service featured by the card. For example, the disclosed three-value card depicted in FIG. 1 contains a graphic of a sailboat on open water as the graphic commentary for the text "Social Security Card." This graphic commentary is designed to highlight the lofty, though perhaps unrealistic view of Social Security in society. Specifically, it is designed to call to mind the myth that Social Security is established to provide the means to retire by sailing away on a blissful body of water.

The third feature of an three-value card is the category feature. Each three-value card is categorized by way of a letter 12 that appears in the lower right-hand corner of the card. In the current embodiment, there are five different categories of three-value cards: transportation ("T"), housing ("H"), insurance ("I"), employment ("E"), and general asset ("A"). The embodiment presented in FIG. 1 is titled "Social Security Card". The category of this card is "A", i.e. general asset. These categories are used in advanced levels of game-playing. Specifically, to be declared the winner of the advanced version of this game, a player must not only accumulate the most value in three-value cards, but the winner must also collect cards for each category of three-value card. In other versions of the game, the winner is the person who collects the most value in each category of three-value cards.

Different groups place different value on certain goods and services. The three value feature 13 of the three-value card captures this phenomenon. Instead of one number providing a single numerical value for a particular good or service depicted on a card, an three-value card has three values assigned to that good or service. The top number in the upper-left hand corner of the three-value card 13*a* provides the numerical value of the featured good or service as perceived by members of a particular demographic category (in the preferred embodiment this category is a generational group called the "World Warrior" generation, i.e. those born prior to the close of World War II). The second number from the top upper-left-hand corner of the three-value card 13*b*, provides the value attached to the good or service by a different category of demographic (in the preferred embodiment this category is a generational group called the "Baby Boom" generation, i.e. those born between 1945 and 1964). The bottom number of those that appear in the upper left-hand corner of the three-value card 13*c* provides the value of the depicted asset as seen by a third category of demographic (in the preferred embodiment this category is a generational group called the "Generation X" generation, i.e. those born between 1964 and 1980). For example, the three-value card depicted in FIG. 1 is labeled 10 "Social Security Card." Examining the valuation feature of the card, one sees that the Social Security card has a value of 1000 to those players who decided, at the beginning of the game, to compete as members of the senior citizen generation; a value of 500 to those players who had decided to compete as members of the Baby Boomer generation; and a value of zero to those players who chose to play the game as members of the Generation X generation.

The valuation feature of the three-value card introduces a unique dynamic to this game. Though players of traditional playing card games must rely, largely, on chance to acquire valuable playing cards, here attaining the highest value in three-value cards is a function of difficult strategic choices. Since the value of a particular card varies from player to player, decision to deposit a particular card into one's Accumulated Asset Pile must consider not only the value of the card to the player who holds the card, but the potential value of the card to an opposing player should the card be placed back into circulation rather than retained. Taking a card from the preferred embodiment, the Social Security Card, as an example, a player who has chosen to play as a member of Generation X would, in a traditional card game, have no incentive to retain, for his Accumulated Asset Pile, a card with zero value. Yet, because of the three value character of this game, a Generation X player would have to think long and hard about discarding back into play a card that has such high value to his competitors. The retention of the Social Security card, however, might come at the opportunity cost of retaining a card of actual value to the Generation X player.

Figure 2:
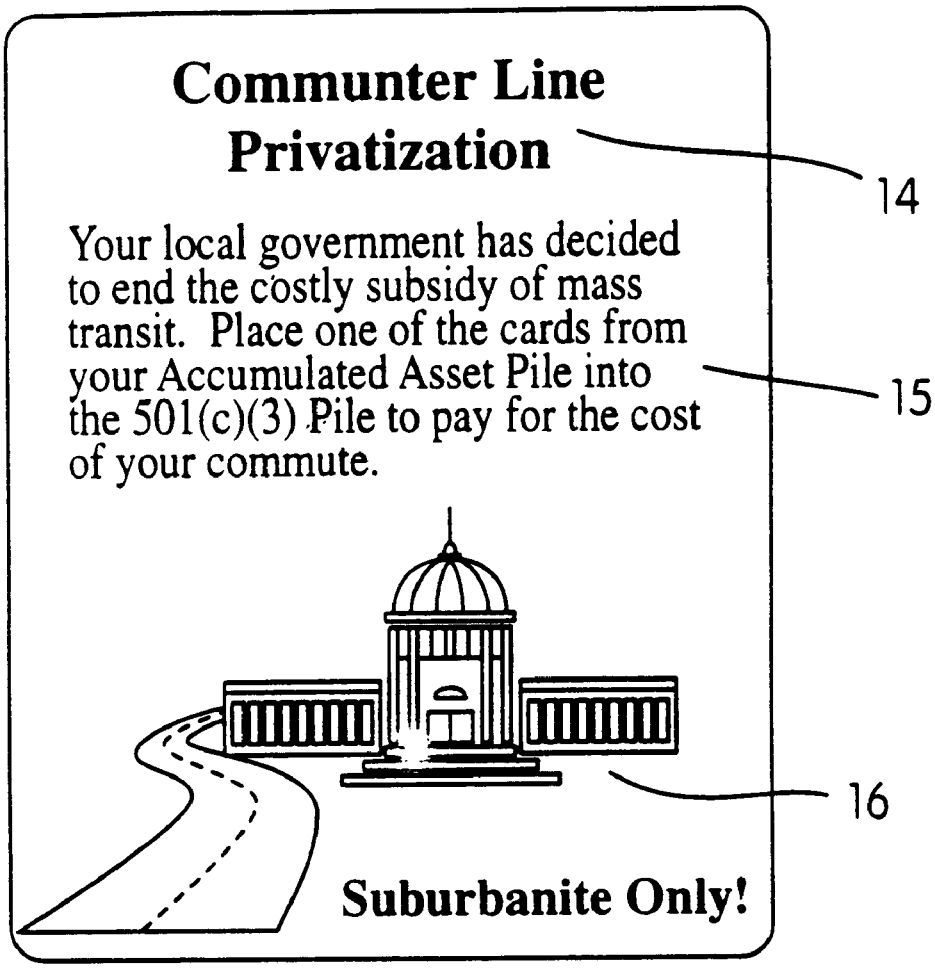
FIG. 2—Is the front view of a typical policy card.

Policy cards are cards that the players play against each other in order to slow each other's accumulation of three-value cards. In the preferred embodiment, the policy cards represent, in effect, disruptions to the process of accumulating wealth or procuring services caused by various public events. An example of a policy card taken from the preferred embodiment is depicted in FIG. 2. Policy cards have three features: (1) the title feature, (2) the instruction feature, and (3) the graphic commentary feature. This policy Card disclosed is the "Commuter Line Privatization" card. The public policy preference represented by this card is the privatization of a commuter rail line. This card represents a policy choice of requiring suburban dwellers to transfer assets into the 501(c)(3) Pile by dropping government support of mass transit. In FIG. 2, the title feature 14 names the event that will place an obstacle in the path of the player against whom it is played accumulating three-value cards—here "Commuter Rail Privatization." Next, the instruction feature 15 contains text which serves to instruct the player against whom the policy card has been played about what they must do to comply with the requirements of the card. In the policy card that has been disclosed in FIG. 2, the card states that the player against whom the card has been played must place one of the cards from her Accumulated Asset Pile into the 501(c)(3) Pile. Generally speaking, policy cards may be played by any player against any player. However, this policy card can be played only against a player who, before the initial cards were distributed at the start of the game, chose to be part of the suburban category rather than the urban category. The graphic commentary feature 16 provides an opportunity for editorial commentary on the policy instructions contained in the card. It achieves this editorial function by conjuring up many of the symbols that, in their short-hand fashion, call to mind significant events in popular and political culture, and the public ethos engendered by such symbols. In the policy card disclosed in Feature 2, the graphic commentary feature contains the image of an asphalt road running adjacent to, if not into, a building drawn to resemble a state legislature. Through these graphics, the graphic commentary feature seeks to communicate the power of the road-building (as opposed to, for example, rail-building) interests in our society. It is also drawn to communicate that the road-builders have easy access to the halls of government.

Disaster cards represent natural and man-made disasters. These cards cause a catastrophic disruption in a player's accumulation of three-value cards. Disaster cards are not distributed to the players or included in the Pick Up Pile at the start of the game. In the later part stages of the game, however, disaster cards might appear in the Pick Up Pile. Disaster cards are stored in the Recycling Bin and are entered into the game if and only if one or more cards is discarded into the Recycling Bin. If cards are discarded into the Recycling Bin, those cards are shuffled with the disaster cards that have been stored there, and are placed in the Pick Up Pile. The game is thus continued by the replenishment of the Pick Up Pile. The unfortunate player who, by chance, picks up a disaster card from the Pick Up Pile must immediately follow the instructions on the face of the card.

Figure 3:
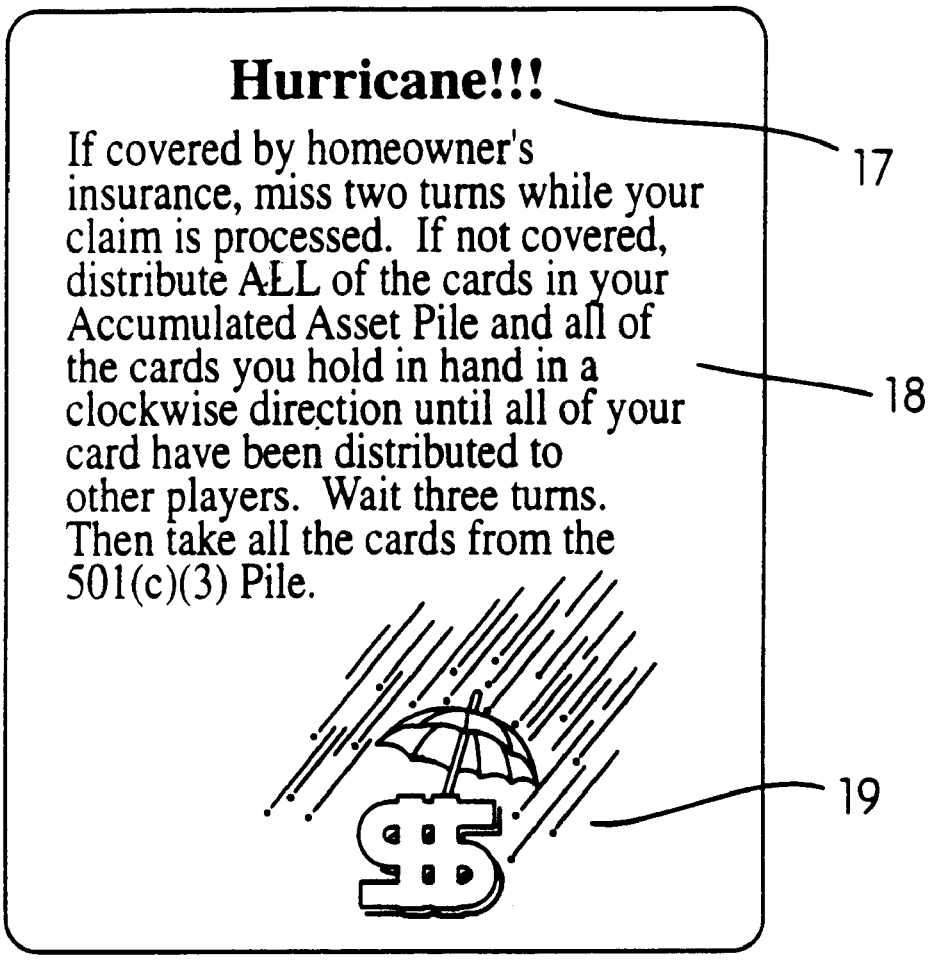
FIG. 3—Is the front view of a typical disaster card.
Figure 4:
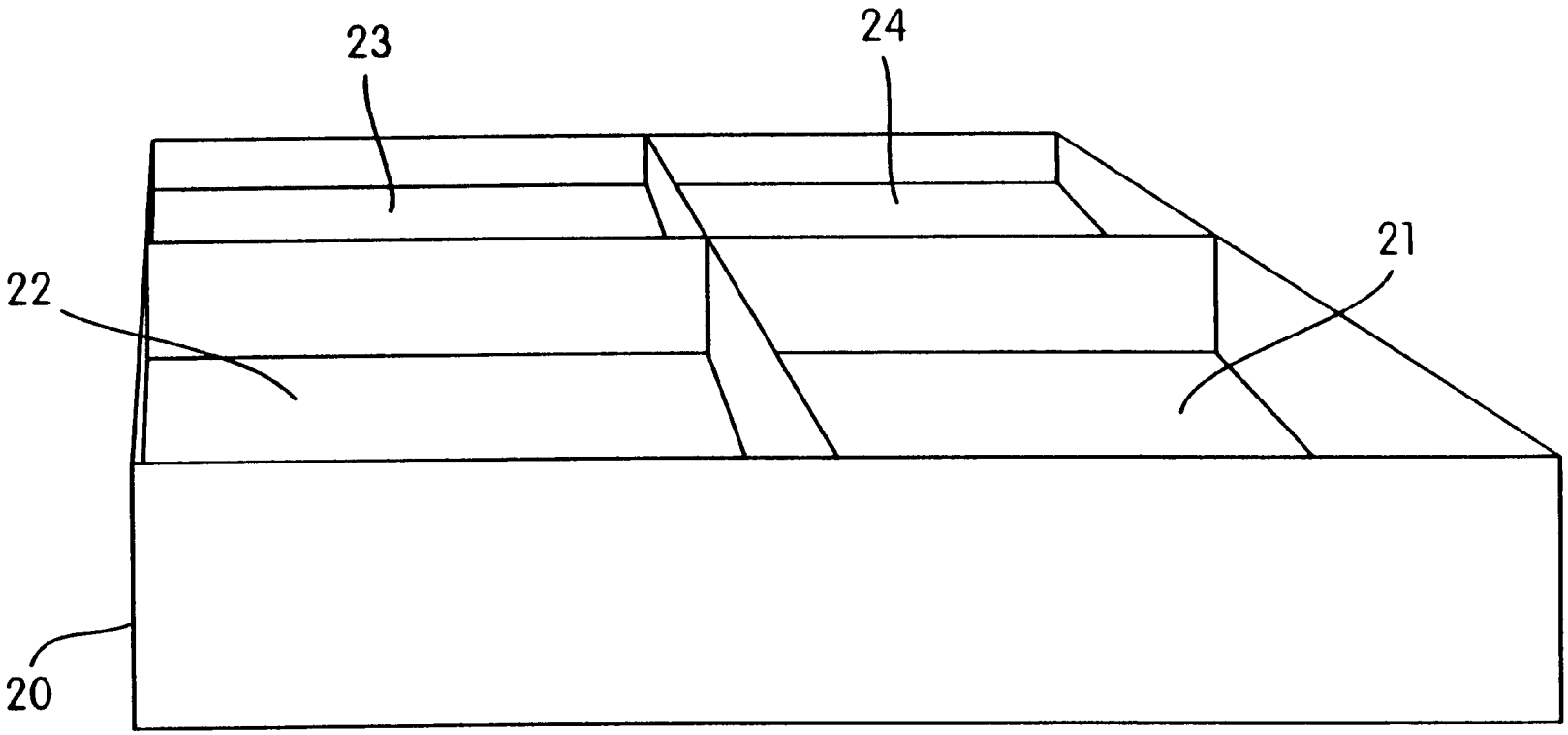
FIG. 4—Is a view of the card holding indicating the Pick Up Pile, the Litigation Fund, the 501(3)(3) Pile, and the Recycling Bin.
Figure 5:
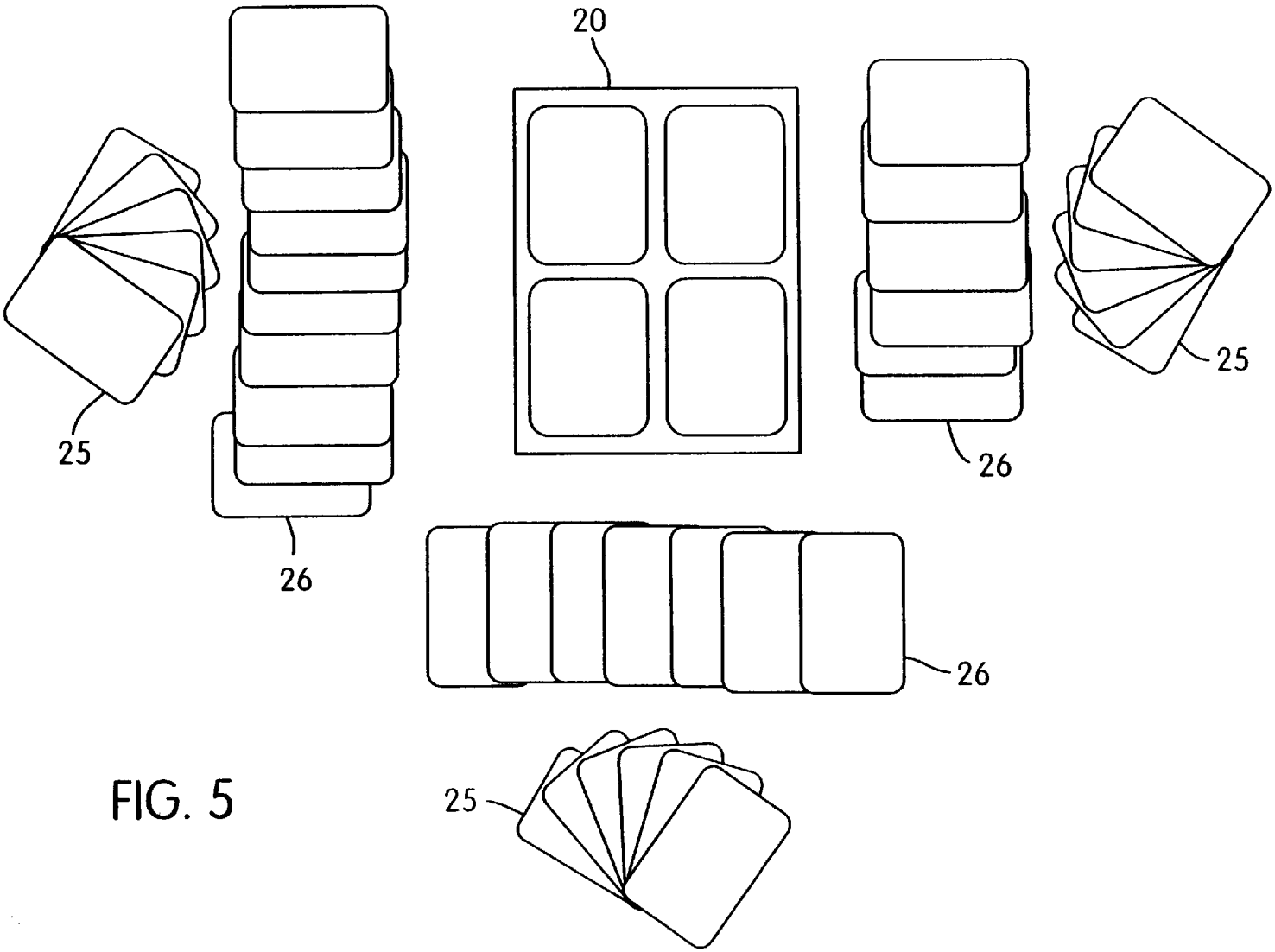
FIG. 5—Is a diagram of the lay out of playing cards among the players.
Figure 6:
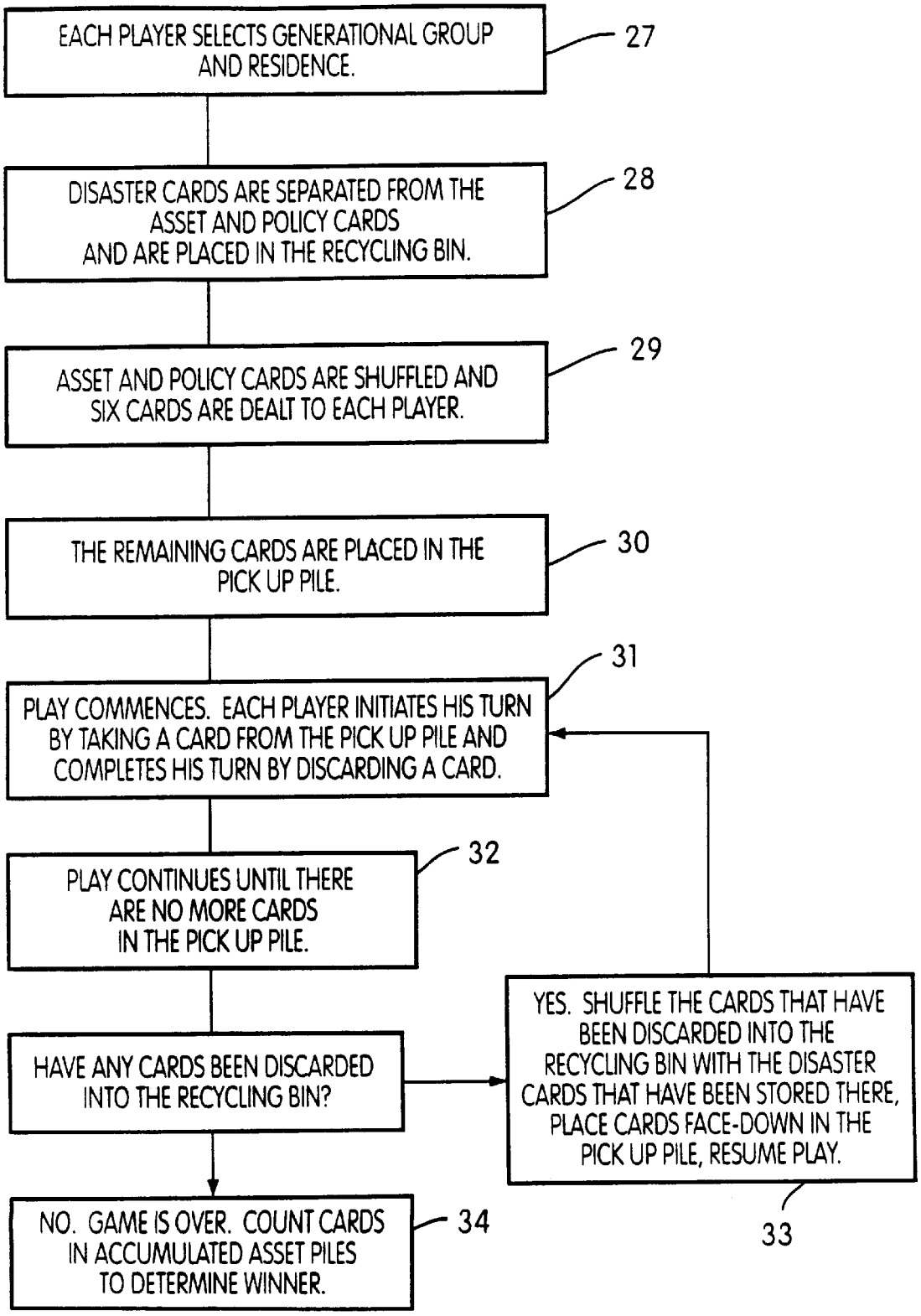
FIG. 6—Is a schematic diagram of the sequence of play.
Figure 7:
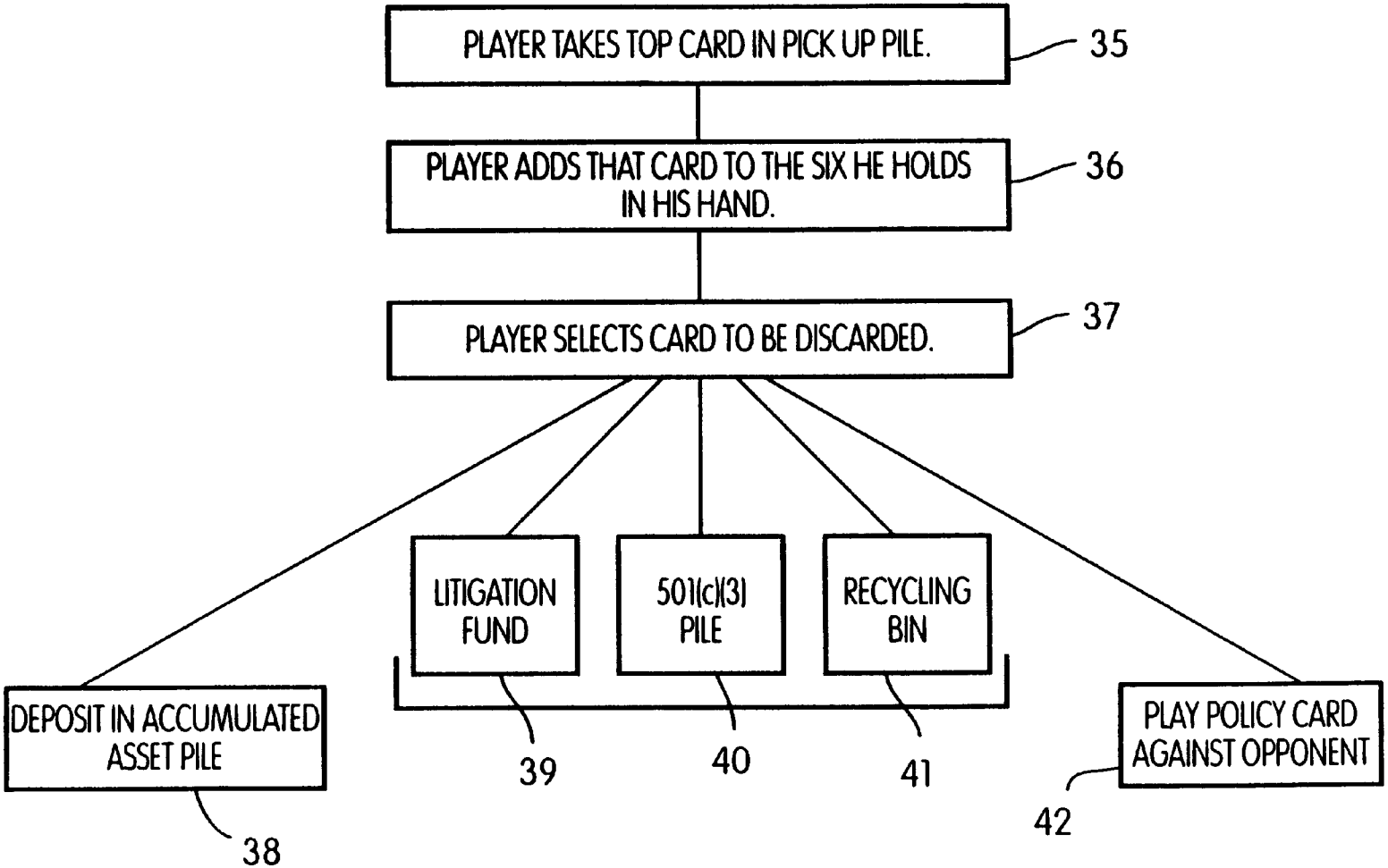
FIG. 7—Is a schematic diagram of the sequence of possible discards available to a player to end his or her turn.

Disaster cards have three features: (1) the title feature, (2) the instruction feature, and (3) the graphic commentary feature. The disaster card disclosed in FIG. 3 is titled 17 "Hurricane." The instruction feature 18 tells the player against whom the card has been played that, if they have home owner's insurance (one of the three-value cards described previously), that player must wait two turns for the insurance company to process his insurance claim before that player may rejoin the game. The card states that if they player against whom this card has been played is not insured (i.e. that player does not have an "insurance" three-value card) that player must distribute all of their cards, in a clockwise direction until that player has distributed all of his cards to the other players. Then, after waiting for three turns, the player against whom the Hurricane Card was played, takes all of the cards in the 501(c)(3) Pile. The graphic commentary feature 19 presents the image of an umbrella being held up by a fist full of dollars. The editorial comment made by this feature of the Policy Card is that it takes a lot of money in order to be sheltered from the disastrous effects of a hurricane.

The card holder 20 has four separate card holders. These holders are the repositories for the Pick Up Pile 21, the Recycling Bin 22, the Litigation Fund 23, and the 501(c)(3) Pile 24.

The Pick Up Pile 21 enters the playing cards into the game. Each player initiates his turn by taking the top card from the Pick Up Pile and adding it to the six cards held in that player's hand 31.

The cards in the Recycling Pile 22 extend the duration of the game. Once all the cards have been picked up from the Pick Up Pile, the cards that have been discarded into the Recycling Bin are shuffled and placed face-down in the Pick Up Pile. The Recycling Bin is also the repository of the disaster cards. Disaster cards are not distributed with the Asset and policy cards at the beginning of the game 28. Instead, they are all placed, face-down, in the Recycling Bin. If no player discards into the Recycling Bin, the disaster cards remain, inert, in the Recycling Bin and the game concludes as soon as the last card in the Pick Up Pile is drawn. If, however, so much as one card is added to the Recycling Bin, that card will be shuffled with the disaster cards and added to the Pick Up Pile once the Pick Up Pile is depleted 33. Thus, a player who discards into the Recycling Bin makes a deliberate choice to enter all of the disaster cards into play.

The cards that are placed in the Litigation Fund 23 represents the portion of society's resources dedicated to the legal process. The cards collected in the Litigation Fund serve as a safety net for players who are victimized by certain policy or disaster cards. At the beginning of the game, there are no cards in the Litigation Fund. Contributions to the Litigation Fund are generally voluntary, though certain policy cards and disaster cards will force contributions to the Litigation Fund. Players must exercise their discretion with regard to how many cards it is appropriate to have in the Litigation Fund. Typically, there are never enough cards in the Litigation Fund when one is forced to rely upon it. However, when one's competitor collects from the Litigation Fund, there always seem to be too many cards in that pile.

The 501(c)(3) Pile 24 is the repository for cards that players seek to donate to charitable institutions. As with the Litigation Fund, the 501(c)(3) Pile holder is empty at the start of play. The cards accumulate in the 50(c)(3) Pile by players voluntarily discarding cards into it. Some policy cards and will force contributions to the 501(c)(3) Pile. Like the Litigation Fund, various players will have to rely on the 501(c)(3) Pile when certain policy cards are played against them or when a player is unfortunate enough to have picked up a disaster card from the Pick Up Pile.

The Litigation Fund and the 501(c)(3) Pile are referred to broadly as deposit piles since cards from a player's hand are deposited into these piles. This is in contrast to discarding a card into the Recycling Bin or playing a policy card against another player.

Playing the Game

In preparation for play, each player must make an initial choice of "who" they will be for game-playing purposes by choosing from several predesignated categories 27. In the preferred embodiment, a player must first identify the generational group to which they belong. These generational groups are the World Warriors, those with birthdays in 1945 and earlier; the Baby Boomers, those with birthdays between 1946 and 1964; and the Generation X'ers, those with birth years between 1965 and 1981. The game will encompass future generation groups as they are identified. Second, each player must identify a sub-category to differentiate him or herself from the other players who may have picked the same initial category. In the preferred embodiment, each player must announce whether he or she is a resident of the city or a resident of the suburbs. These identifications are critically important to the play and outcome of the game because the particular value of three-value cards and the effect of certain policy cards will vary depending upon the initial category choices of the player who holds the card.

Once the players have selected their fictitious roles, and after the Asset and policy cards are shuffled together, each player is dealt a predetermined number of cards (in the preferred embodiment, each player is dealt six cards) 29. The cards that have been dealt to each player are held in-hand, i.e. secluded from view by the other players 25. Though the composition of the cards that are held in-hand will change throughout the game, each player must hold, at the end of his turn, the pre-determined number of cards (six cards in the preferred embodiment) in order to continue in the game. If a player, for reasons described in more detail below, finishes his turn and does not have the required number of cards in-hand, that player is eliminated from the game.

After the Dealer has dealt cards to each player, the remaining cards are placed, face-down, in the Pick Up Pile 30. The Pick Up Pile enters the playing cards into the game. Each player initiates his turn by taking the top card from the Pick Up Pile and adding it to the cards held, secluded from view, in that player's hand 31, 36. A turn is complete when the player chooses an appropriate discard leaving that player with the required number of in-hand cards 37. There are five discard options available to a player. First, a player may add a card to her Accumulated Asset Pile 38. Second, a player may opt to make a contribution to the Litigation Fund 39. Third, a player may opt to make a contribution to the 501(c)(3) Pile 40. Fourth, a player may choose to discard into the Recycling Bin 41. Fifth, a player may opt to play a policy card against another player 42. Regardless of the choice that is ultimately made, a player must balance the addition of the card taken from the Pick-Up Pile with a corresponding discard to ensure that only the required number of cards are held in that player's hand by the end of that player's turn. There will be times when a player will collect a number of cards during a single turn. Such a situation will arise, for example, when a policy card or disaster card instructs a player to collect all of the cards in the Litigation Fund or the 501(c)(3) Pile. In such a situation, a player must discard however many cards is necessary to comply with the six card rule. There will also be situations in which a player finishes his turn and finds that he does not have six cards held in-hand. Such a situation arises when, for example, a player has been hit with a policy or disaster card that instructs the player to surrender in-hand cards in exchange for cards in the Litigation Fund or the 501(c)(3) Pile yet the player discovers that there are less than six cards available in those piles. In such a situation player who does not have six cards in his hand is eliminated from the game.

To play a policy card against another player, the player seeking to play the card initiates his or her turn in the usual manner, i.e. taking the top card in the Pick Up Pile. To complete his or her turn, however, the player places the selected policy card adjacent to another player's Accumulated Asset Pile. A Player who has a policy card played against him must wait until it is his turn before complying with the terms indicated on the card. When that player's turn arrives, the player who has had the policy card played against him must comply with the terms listed on the policy card before picking the top card from the Pick Up Pile as he would ordinarily do to initiate his turn.

Using FIG. 2 as an example, suppose Player A decides to play the "Commuter Line Privatization" card against Player C (who, by the terms provided on the card, must be a resident of the suburbs). Player A begins her turn as she normally would by taking the top card from the Pick Up Pile. Then, to play the policy card, Player A discards by placing the "Commuter Line Privatization" card next to the "Accumulated Asset Pile" of player C. After A has completed her turn, player B completes his turn. Next, it is player C's turn. Before picking up the top card in the Pick Up Pile, Player C must read and comply with the terms of the "Commuter Line Privatization" card. As the instructions on the Commuter Line Privatization card read, "Your commuter line has been privatized. Place one of the cards in your Accumulated Asset Pile into the 501(c)(3) Pile to cover the cost of increased fares." Once Player C complies with the terms on the policy card, he can then initiate and complete his turn as he normally would have.

Disaster cards are put into play only after there has been a discard into the Recycling Bin. Cards that are deposited into the Recycling Bin are shuffled with the disaster cards that are stored there and then placed face down in the Pick Up Pile once the cards in the Pick Up Pile have been depleted. Using FIG. 3 as an example, the player who is unfortunate enough to take the "Hurricane" card from the Pick Up Pile had better have a homeowner's insurance three-value card. If the player has a homeowner's insurance three-value card, then that player will only have to miss two turns to wait for his claim to be processed. If the player does not possess a homeowner's insurance three-value card, then that player must distribute all of the cards that are in the player's Accumulated Asset Pile, wait three turns, and then take all of the cards that are in the 501(c)(3) Pile. An encounter with such a disaster card may force a player from the game if, when it is time for that player to take "all the cards" from the 501(c)(3) Pile, there are no cards to be had. A lot can happen from the time a disaster card forces a player to surrender all of his cards, and when that player is entitled to take from the 501(c)(3) Pile. For example, other players may have to rely on the 501(c)(3) Pile leaving no cards at all. Conversely, a player might look into the 501(c)(3) Pile after being hit with a disaster cards and see no cards at all. In such a situation, it is within the power of the other players to either keep that unlucky player in the game by depositing cards into the otherwise empty 501(c)(3), or to deliberately eliminate this player from the game by leaving the

What is claimed is:

1. A method of playing a card game by a plurality of players comprising the steps of:

providing value cards having at least two point values, policy cards indicating a policy and instruction, and disaster cards identifying a disaster and instruction;

designating piles for a pick-up pile, a discard pile and first and second deposit piles;

prior to initiating the game, separating disaster cards from value cards and policy cards, and storing the disaster cards separately;

prior to initiating the game, each player selecting a role characteristic that determines the value of any value card to the player;

initiating play by distributing a predetermined number of cards from value cards and policy cards face-down to each player to form a hand;

placing remaining cards in the pick-up pile;

each player, in sequence, taking a turn comprising the steps of drawing the topmost card from the pick-up pile, adding the drawn card to the cards in the player's hand, comparing the drawn card to the cards in the player's hand and discarding a card from the hand so as to maintain the predetermined number of cards, said discarding step comprising the options of discarding into the discard pile, depositing a card into one of the deposit piles, playing a policy card against another player, or depositing a value card into a player's own accumulated assets pile;

play terminating when there are no more cards in the pick-up pile, at which time each player adds together the value of cards in their accumulated asset pile, the player which the highest total point value in their accumulated asset pile being the winner.

2. The method of playing a card game of claim 1, wherein the role characteristic to be selected by each player is demographic, such that value cards reflect different point values according to the demographic characteristic that has been selected by the player holding the value card.

3. The method of playing a card game of claim 2, wherein the winner is determined to be the player who achieves the highest point total of value cards in the accumulated assets pile in accordance with the player's demographic role characteristic.

4. The method of playing a card game of claim 1, wherein any player not having the predetermined number of cards in the hand at the end of a turn is eliminated from the game.

5. The method of playing a card game of claim 1, comprising the step of complying with the terms of the policy card as part of taking a turn.

6. The method of playing a card game of claim 5, wherein complying with a policy card is mitigated by drawing a card from one of the deposit piles.

7. The method of playing a card game of claim 1, wherein said step of initiating includes a step of placing the disaster cards into the discard pile.

8. The method of playing a card game of claim 7, further comprising the step of shuffling all cards in the discard pile when the pick-up pile is depleted and replenishing the pick-up pile by placing the shuffled cards face down in the pick-up pile to thereby extend play.

9. The method of playing a card game of claim 8, comprising the step of complying with any disaster card drawn from the replenished pick-up pile as part of taking a turn.

10. The method of playing a card game of claim 9, wherein complying with a disaster card is mitigated by drawing a card from one of the deposit piles.

11. The method of playing a card game of claim 9, wherein the accumulation of value cards into a player's accumulated assets pile is slowed by play of policy cards and disaster cards.

12. The method of playing a card game of claim 1, further comprising supplementing value, policy, or disaster cards with new cards that relate to noteworthy events, figures or symbols such that the game becomes a continuous critique of current issues in modern society.

* * * * *